US005356001A

United States Patent [19]

Luna

[11] Patent Number: 5,356,001

[45] Date of Patent: Oct. 18, 1994

[54] FOLDING SPORTS NET

[76] Inventor: Mary M. Luna, 703 W. Main St., Carson City, Mich. 48811

[21] Appl. No.: 5,025

[22] Filed: Jan. 15, 1993

[51] Int. Cl.[5] ..... B65D 85/20; B65D 85/00

[52] U.S. Cl. ..... 206/315.1; 206/315.9; 248/99; 248/101; 383/34

[58] Field of Search ..... 206/315.1, 315.9, 526; 383/33, 34; 248/99, 101, 231.7

[56] References Cited

U.S. PATENT DOCUMENTS

| | | | |
|---|---|---|---|
| D. 327,458 | 6/1992 | Martinell . | |
| 1,021,650 | 3/1912 | Worthington | 248/351 |
| 1,522,998 | 1/1925 | Buerger et al. | 248/351 |
| 1,565,118 | 12/1925 | Stugard | 248/101 |
| 1,809,317 | 6/1931 | Snyder | 248/101 |
| 2,113,153 | 5/1938 | Jonassen | 248/101 |
| 2,213,930 | 9/1940 | Hoffman . | |
| 2,213,937 | 9/1940 | Tompkins et al. | 248/99 |
| 2,444,236 | 6/1948 | Williams | 248/99 |
| 2,517,183 | 8/1950 | Dunn et al. | 248/351 |
| 2,726,477 | 12/1955 | Firkins . | |
| 2,744,709 | 5/1956 | Gronek | 248/99 |
| 3,614,041 | 10/1971 | Koger | 248/101 |
| 3,716,938 | 2/1973 | Ammons . | |
| 3,779,496 | 12/1973 | Welles | 248/99 |
| 3,796,402 | 3/1974 | Trotta | 248/101 |
| 3,814,359 | 6/1974 | Powell | 248/97 |
| 3,841,592 | 10/1974 | Witten | 248/107 |
| 3,991,961 | 11/1976 | Platzer, Jr. . | |
| 4,304,379 | 12/1981 | Christensen . | |
| 4,378,924 | 4/1983 | Christensen . | |
| 4,537,377 | 8/1985 | Shewchuk . | |
| 4,620,319 | 10/1986 | Sheehan et al. | 383/33 |
| 4,695,020 | 9/1987 | Collins . | |
| 4,842,239 | 6/1989 | Kinsey et al. | 248/351 |
| 4,926,060 | 5/1990 | Sittig | 248/100 |
| 5,014,943 | 5/1991 | Nelson et al. . | |
| 5,098,108 | 3/1992 | McKinney | 273/400 |

FOREIGN PATENT DOCUMENTS

| | | | |
|---|---|---|---|
| 142866 | 7/1980 | Fed. Rep. of Germany | 248/95 |

*Primary Examiner*—Paul T. Sewell
*Assistant Examiner*—Marie Denise Patterson
*Attorney, Agent, or Firm*—Price, Heneveld, Cooper, DeWitt & Litton

[57] ABSTRACT

A collapsible or folding storage container adapted to be mounted on a wall or other vertical support and includes a frame having a closed net dependent therefrom, and tangentially interconnected by a hinge to a first mounting plate to be secured to the wall or upright support. The frame is supported in a first position by a pair of support arms, each having a first end interconnected by a hinge to a second mounting plate attached to the wall or upright support, and a second end detachably coupled to the frame. When not in use, the frame may be detached from the support arm and be suspended from the mounting plate by the hinge. The support arms may be moved upward and stored adjacent the mounting plates. The folding storage container is preferably molded from a polymeric material in no more than three individual components. The polymeric material provides the living hinges interconnecting the mounting plates and the respective structures.

14 Claims, 2 Drawing Sheets

FOLDING SPORTS NET

CROSS-REFERENCE TO RELATED DOCUMENTS

This invention was first disclosed in a Disclosure Document No. 312,024, filed in the United States Patent and Trademark Office on Jun. 29, 1992, incorporated herein by reference.

FIELD OF THE INVENTION

The present invention relates in general to a storage container, and more particularly, to a container used to store athletic equipment such as basketballs, footballs, and the like, and which can be folded generally parallel to the supporting structure when not in use.

DISCUSSION OF THE RELATED ART

In the home, school gymnasium, recreation center, and health club, the storing of sports equipment such as basketballs, footballs, volleyballs and the like, require bulky containers which are difficult to store, inconvenient to use, and usually unattractive. Typically, such equipment is stored in wooden or plastic boxes, or cloth or plastic bags closed by a drawstring. With rigid containers such as boxes, it is inconvenient to find a particular piece of equipment, particularly when located at the bottom of a container. One advantage of the rigid container, however, is the rigid and wide opening to receive the equipment therein. Similarly, with drawstring duffle bags or the like, it is often the case that the entire bag must be emptied to find the desired piece of equipment. Also, the loose drawstring opening makes it difficult to place the equipment therein.

Various types of equipment for holding a bag in an open position are, of course, known. These known devices fall generally into two categories: collapsible and uncollapsible. Typically, both types of devices are designed to be fastened to a wall or other vertical member so as to hold the bag in a generally vertical orientation to receive the articles therein. Of course, the noncollapsible bag holders are fixed in a position and always protrude from the wall whether they are being used or not. The collapsible type often include many different components which must be assembled either by the manufacturer or the user. The many components require maintenance of a parts inventory resulting in increased costs. Preassembly of the device by the manufacturer also results in increased costs while assembly by the user is frequently inconvenient and often intimidating.

SUMMARY OF THE INVENTION

The present invention provides a collapsible or folding storage container to be mounted on a wall or other vertical support and includes a frame having a closed net dependent therefrom. The frame defines an aperture in the net for receiving the articles therein- The frame is tangentially interconnected by a hinge to a first mounting plate to be secured to the wall or upright support. The frame is supported in a first position by a support arm having a first end interconnected by a hinge to a second mounting plate attached to the wall or upright support, and a second end detachably coupled to the frame. When not in use, the frame may be detached from the support arm and allowed to swing about the hinge point to a position generally parallel to the wall or upright support. The support arms may also be stored generally parallel to the wall or upright support and detachably retained in place adjacent the first mounting plate.

According to another aspect of the invention, the frame, hinge, and first mounting plate, are integral with each other, being molded as a unitary article from a polymeric material. The support arm, hinge, and second mounting plate, may also be formed as a unitary article, being molded from the same polymeric material.

In accordance with another aspect of the invention, the second end of the support arms include a clamp or latch adapted to engage the frame to support the frame in the extended position. The second ends of the support arms also include a latching mechanism for retaining the support arms adjacent the first mounting plate with the container in a collapsed or folded position.

The advantages provided by this invention include a simple structure for holding a container or bag open with fewer parts, resulting in less expense and less frustration to both the manufacturer and user. Yet another advantage is that the device may be moved to the collapsed or folded position while the net and/or container holds the articles stored therein.

BRIEF DESCRIPTION OF THE DRAWING FIGURES

DETAILED DESCRIPTION OF THE INVENTION

Figure 1:
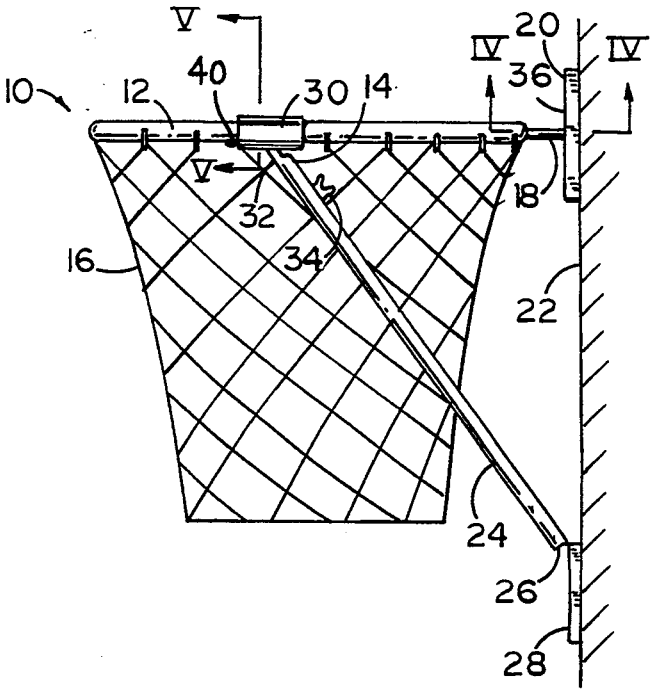
FIG. 1 is a side elevational view of the invention in a first or extended position.
Figure 2:
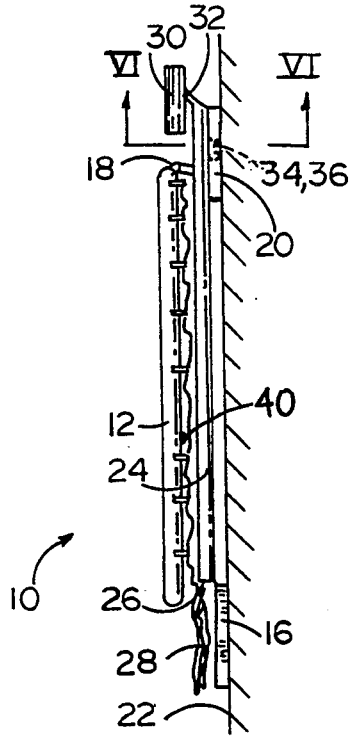
FIG. 2 is a side elevational view of the invention in a second, collapsed or folded position.

Referring now to the drawing figures, and in particular to FIG. 1, there is shown a side elevational view of the collapsible or foldable storage container 10 generally including a circular frame 12 for suspending a net 16 from a plurality of hooks disposed about the perimeter of frame 12. A hinge 18 interconnects an outer peripheral edge of frame 12 with a first mounting plate 20 adapted to be secured to a wall or other upright structure 22.

Figure 3:
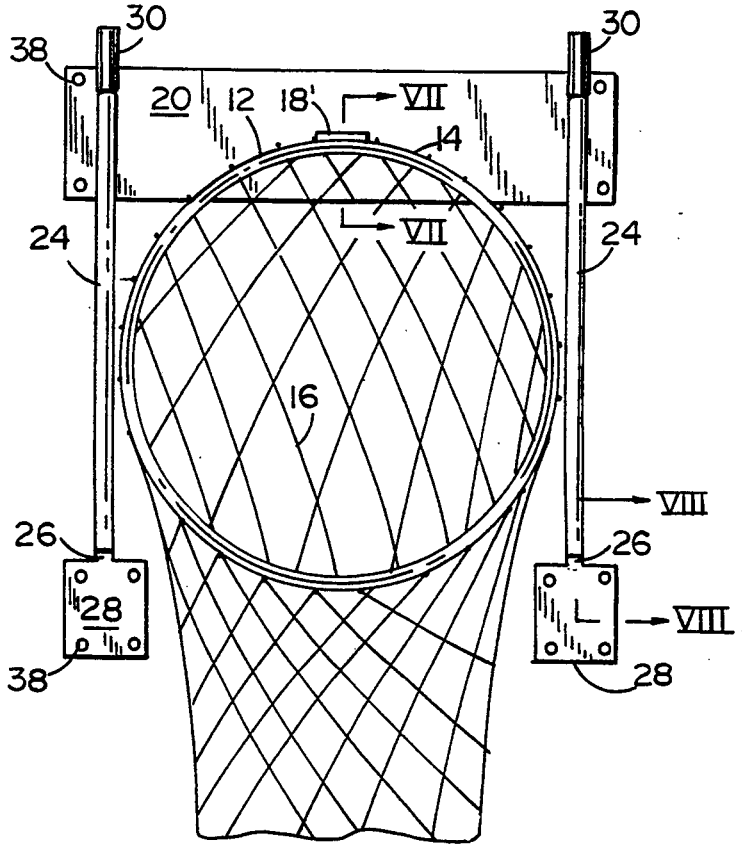
FIG. 3 is a front elevational view of the invention as shown in FIG. 2.
Figure 4:
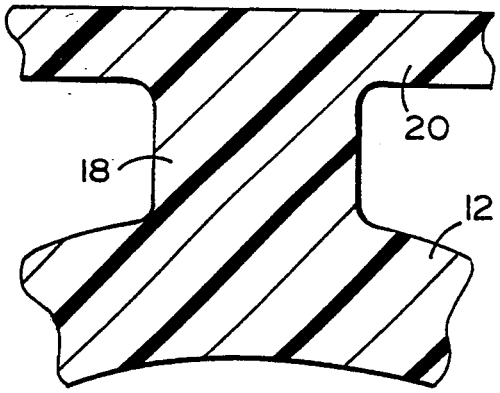
FIG. 4 is a fragmentary, section view through the living hinge tangentially interconnecting the frame to the first mounting plate taken along lines IV—IV in FIG. 1.
Figure 5:
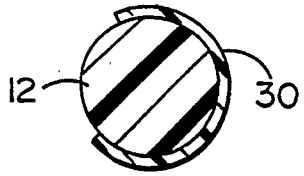
FIG. 5 is a fragmentary, sectional view through the supporting arm clamp attached to the frame taken along lines V—V shown in FIG. 1.

Supporting frame 12 out from first mounting plate 20 are two support arms 24, each having a first end 26 interconnected by a hinge 32 to a second mounting plate 28, also adapted to be secured to wall 22. The second or opposite end of each support arm 24 includes a C-shaped clamp or coupler 30 adapted to detachably engage a portion of frame 12. C-shaped clamp 30 is coupled to the second end of support arm 24 through a hinge 32. Located proximate hinge 32 on support arm 24 is a split pin or peg latch 34 to be received in and held in a hole or cavity 36 defined in the first mounting plate 20. It is preferred that support arms 24 be located such as shown in FIG. 3 so as to support opposite portions of rim or frame 12.

Figure 6:
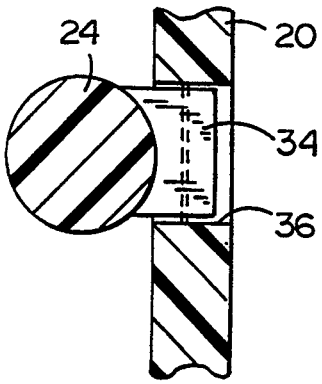
FIG. 6 is a fragmentary, sectional view of a latching mechanism used to retain the support arm adjacent the first mounting plate taken along lines VI—VI shown in FIG. 2.
Figure 7:
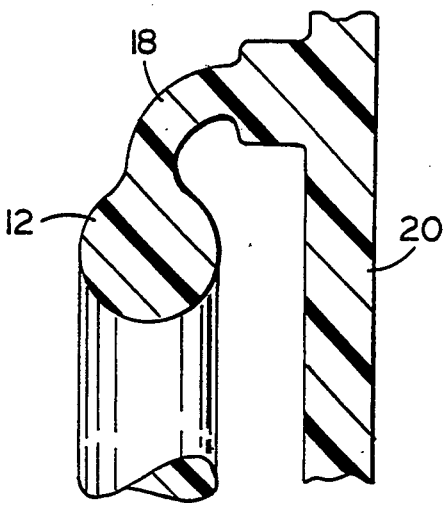
FIG. 7 is a fragmentary, sectional view taken along the living hinge interconnecting the frame with the first mounting plate taken along lines VIII—VIII shown in FIG. 3.
Figure 8:
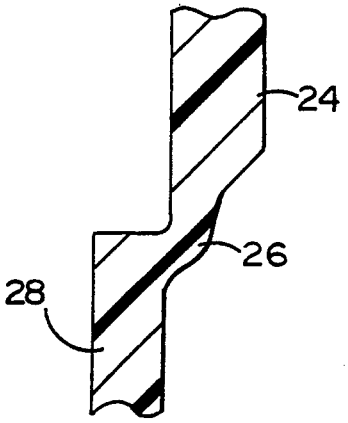
FIG. 8 is a fragmentary, sectional view taken along the living hinge interconnecting the support arm with the second mounting plate along lines VIII—VIII shown in FIG. 3.

FIG. 1 illustrates the collapsible foldable storage container 10 in the upright or extended position wherein frame 12 is oriented substantially horizontally or at an angular orientation with respect to wall or mounting surface 22, by support arms 24. In this orientation, frame 12 and net 16 are able to receive articles to be held or stored within net 16. When not in use, storage container 10 may be collapsed or folded adjacent wall or mounting structure 22 by detaching clamps 30 from the portion of frame 12. This allows frame 12 to swing downwardly about hinge 18, and be suspended therefrom to lie substantially in a vertical orientation and preferably parallel to wall 22. Each supporting arm 24 may be folded or moved upwardly about hinges 26 adjacent wall 22 and retained in a substantially vertical position by latching pin 34 received within hole 36 defined in the first mounting plate 20 (see FIG. 6).

Frame 12, hinge 18, and first mounting plate 20 are preferably formed as a single unit from plastic. A preferred material would have an elasticity such that hinge 18 will not fail after a prolonged period of use or when exposed to a wide range of temperatures. The preferred material would also provide substantial rigidity in larger dimensions for rim 12 and mounting plate 20.

It is also preferred that each support arm 24, hinge 26, second mounting plate 28, and clamp 30 be made as a single structure, also from a polymeric material having similar characteristics as described above. Living hinge 26 interconnecting the first end of support arm 24 to second mounting plate 28 is preferably thinner than that of either support arm 24 or mounting plate 28 to allow the hinge to flex. It is also preferred, however, that the polymeric material used be capable of retaining a substantially rigid shape. This characteristic is desired in order for clamp 30 to grip a portion of frame 12 when frame 12 is in the extended or upright position and supported by arm 24. It is preferred that clamp 30 have a radius which substantially conforms to the radius of frame 12 in order to assure and promote a substantially constant clamping force about that portion of the frame to retain the clamp in place and support the frame in the extended or upright position from the first mounting plate 20.

To prevent each clamp 30 from sliding about rim 12, a stop or shoulder 40 may be integrally formed in rim 12. When downward force is applied to rim 12, such as by the weight of contents retained by net 16, each clamp 30 would be urged against each shoulder 40 to prevent a downward rotation of rim 12.

It is anticipated that the collapsible folding container will generally be mounted to a wall. Each mounting plate 20, 28, may be fastened to the wall 22 by screws, bolts, or other types of fasteners through holes 38. The location of holes 38 are shown for the purposes of example only, and it should be understood that other types of fasteners may be used including adhesives, clamps, and the like. For example, container 10 may be attached to a panel or sheet such as a sheet of plywood or similar material, which in turn is attached to a pole or other supporting member.

Although the primary purpose of this invention is to provide a container for storing objects, it is foreseeable that net 16 may be replaced with one which is open at both ends to allow objects to pass therethrough such as one conventionally used in basketball nets. It is also contemplated that the geometric shape of rim or frame 12 may be changed to fit the desired use. For example, instead of a circular rim as shown in the illustrations, rim or frame 12 may be square, rectangular, or oval. The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

The embodiments of the invention in which an exclusive property or privilege is claimed are defined as follows:

1. A collapsible storage container to be mounted to an upright support, comprising:

a ring tangentially interconnected through a living hinge to an integrally connected first mounting plate, said ring movable about said hinge between a first position generally parallel to the upright support and a second position at an angle with respect to the upright support;

at least one support arm having a first end interconnected through a living hinge to an integrally connected second mounting plate, and a second end interconnected through a living hinge to a C-shaped slip detachably receiving a portion of said ring, for supporting said ring at said second position, and said support arm to be stowed adjacent said first mounting plate by a latching structure with said ring in said first position;

said support arm, living hinge and second mounting plate are molded as an integral unit from a polymeric material; and a soft container depending from said ring for receiving articles therein.

2. The collapsible storage container as defined in claim 1, further including a plurality of hooks disposed about a perimeter of said ring for depending said soft container therefrom, said hooks integral with said ring.

3. The collapsible storage container as defined in claim 1, wherein said ring, living hinge and first mounting plate are molded as an integral unit from a polymeric material.

4. The collapsible container as defined in claim 1, wherein said latching structure includes a member extending from said support arm detachably retained by said first mounting plate; and said clip at said end of said support arm detachably engages a portion of said ring.

5. The collapsible container as defined in claim 1, wherein said ring and said first mounting plate are molded from a polymeric material as an integral unit, interconnected by said living hinge; and said support arm and second mounting plate are molded from said polymeric material as a separate integral unit and interconnected by said living hinge.

6. A collapsible container for receiving articles therein, comprising:

a molded unitary frame having a ring coupled through a living hinge to a first mounting plate, said frame rotatable with respect to said first mounting plate about said living hinge between a first position and a second position;

a molded unitary support having a support arm, coupled through a living hinge at one end to a second mounting plate, and detachably coupled by a clamp at a second end to said ring for supporting said ring in said first position, said clamp having a shape conforming to said ring, and coupled to said second end of said support arm by a living hinge; and a net depending from said ring defining an aperture in said net with said ring in said first position, and said ring closing said net with said ring in said second position.

7. The collapsible container as defined in claim 6, further including a latching structure for detachably retaining said support arm adjacent said first mounting plate with said ring in said second position.

8. The collapsible container as defined in claim 6, wherein said clamp has a length and inside diameter conforming to said ring received therein.

9. The collapsible container as defined in claim 8, wherein said first and second mounting plates are attached to a generally vertical mounting surface.

10. The collapsible container as defined in claim 6, wherein said frame and said support are molded from a polymeric material having a strength suitable for a sturdy frame yet flexible for a living hinge.

11. The collapsible container as defined in claim 7, further including a plurality of hooks disposed about said ring for engaging and suspending said net therefrom to form an aperture therein for receiving articles to be stowed therein.

12. A net container for stowing articles, comprising:

a unitary molded polymeric first member having a frame for retaining a net dependent therefrom for receiving the articles therein; a first mounting plate to be attached to a generally vertical mounting structure; and a first living hinge interconnecting said frame to said first mounting plate for allowing pivotal movement of said frame about said hinge between a collapsed, generally vertical position, and an extended, generally nonvertical position;

a unitary molded polymeric second member having at least one support arm with a first end detachably coupled by a clamp at one end to a portion of said frame for supporting said frame in said extended position, said clamp attached to said support arm by a living hinge, and coupled at an opposite end to a second mounting plate by a living hinge, allowing pivotal movement of said support arm about said living hinge between a stowed generally upright position adjacent said first mounting plate and a second supporting position when said clamp is detachably coupled to said portion of said frame.

13. The net container as defined in claim 12, wherein said frame further includes a plurality of hooks dependent therefrom and in paced relation to each other about said frame for depending the net from said frame to form said aperture.

14. The net container as defined in claim 13, further including a latching structure between said first mounting plate and said support arm for detachably retaining said support arm adjacent said first mounting plate in a stowed position while said frame is suspended by said first hinge in said collapsed, generally vertical position.

* * * * *

UNITED STATES PATENT AND TRADEMARK OFFICE

CERTIFICATE OF CORRECTION

PATENT NO. : 5,356,001
DATED : October 18, 1994
INVENTOR(S) : Luna

It is certified that error appears in the above-indentified patent and that said Letters Patent is hereby corrected as shown below:

Col. 1, line 58;
"therein-" should be –therein.–

Col. 4, line 37;
"slip" should be –clip–.

Col. 4, line 55;
After "collapsible" insert –storage–.

Col. 4, line 60;
After "collapsible" insert –storage–.

Col. 6, line 27;
"paced" should be –spaced–.

Signed and Sealed this
Fifth Day of September, 1995

*Attest:*

Bruce Lehman

BRUCE LEHMAN

*Attesting Officer*

*Commissioner of Patents and Trademarks*